United States Patent [19]

Debreuille

[11] Patent Number: 4,662,442

[45] Date of Patent: May 5, 1987

[54] PROCESS AND DEVICE FOR CASING A BOREHOLE FOR THE MEASUREMENT OF THE INTERSTITIAL PRESSURE OF A POROUS MEDIUM

[75] Inventor: Pierre-Jean Debreuille, Paris, France

[73] Assignees: Telemac, Asnieres; Commissariat a l'Energie Atomique, Paris, both of France

[21] Appl. No.: 696,416

[22] Filed: Jan. 30, 1985

[51] Int. Cl.[4] ..... E21B 47/06

[52] U.S. Cl. ..... 166/250; 73/155

[58] Field of Search ..... 166/250, 113; 73/155

[56] References Cited

U.S. PATENT DOCUMENTS

| | | | |
|---|---|---|---|
| 2,981,332 | 4/1961 | Miller et al. | 166/228 |
| 3,534,816 | 10/1970 | Showalter | 166/228 |
| 3,592,056 | 7/1971 | Bernaix | 73/155 |

*Primary Examiner*—Stephen J. Novosad

*Assistant Examiner*—Bruce M. Kisliuk

*Attorney, Agent, or Firm*—Christel, Bean & Linihan

[57] ABSTRACT

The invention relates to a process and a device for casing a borehole made in a porous medium for measuring the pressure of the interstitial fluid, comprising the positioning, in the borehole, of a tube of which at least one section, located at the altitude of the measurement to be effected, possesses radial orifices along one of its generatrices, a porous band between the borehole wall and the outer surface of the section, at the level of said orifices, and a supple inner membrane in the form of a sleeve fitted on the inner face of the tube, the filling of the tube for applying the membrane against its wall and of the space included between the tube and the borehole to saturate said porous band, and the substitution of the outer liquid by a cement grout which bonds the tube to the walls of the borehole in all its zones exempt of porous band.

7 Claims, 6 Drawing Figures

FIG. 1
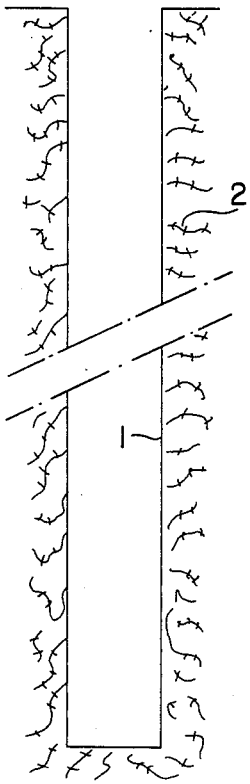
FIG. 2
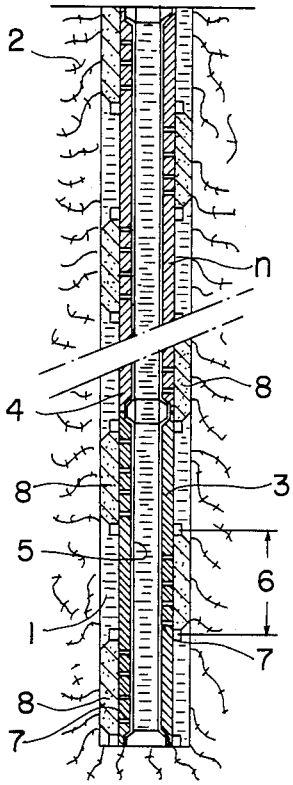
FIG. 3
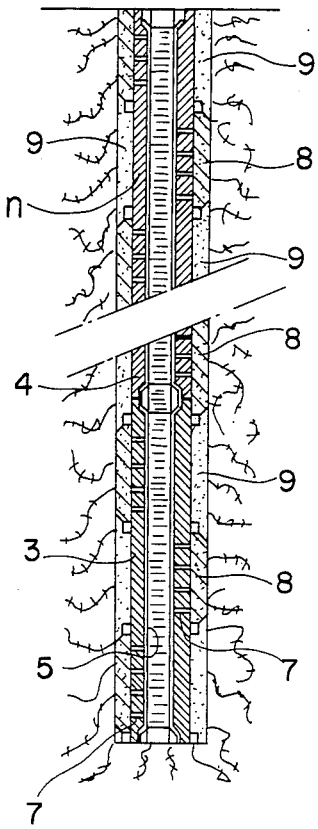
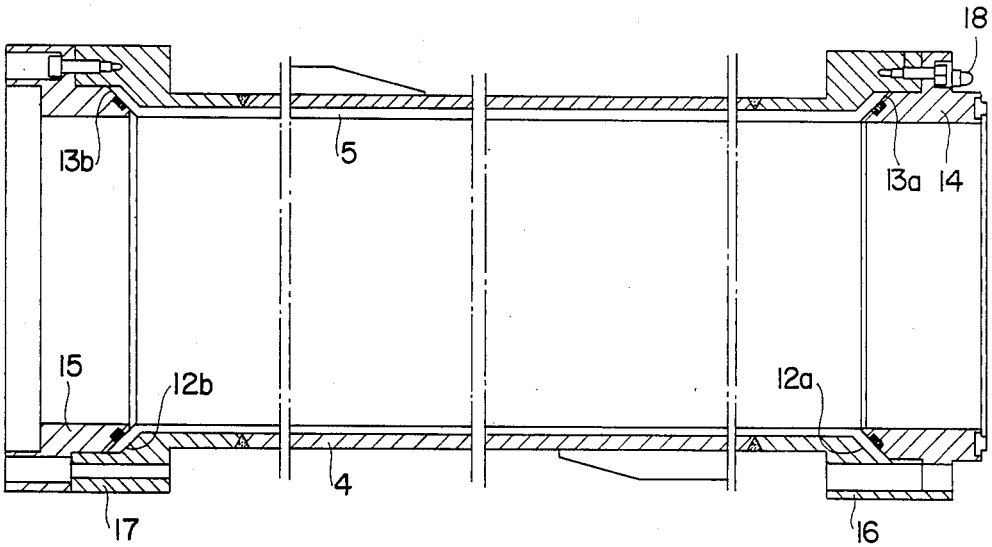
FIG. 6

PROCESS AND DEVICE FOR CASING A BOREHOLE FOR THE MEASUREMENT OF THE INTERSTITIAL PRESSURE OF A POROUS MEDIUM

The present invention relates to a process and a device for casing a borehole made for the measurement of the local pressure of a fluid enclosed in the interstices of a porous medium which may be a rocky massif, a soil, an embankment or an artificial massif of masonry.

The evacuation of toxic or radioactive waste by burying it in the sub-soil is acceptable only if the geological formations surrounding the buried product constitute a sufficient barrier to contain the product for as long as is necessary for its potential nuisance, particularly with regard to the living environment, to have virtually disappeared. It is known that transport of the product thus buried can only be the result of the circulation of underground water. Safety of the containment can therefore be assessed only by knowing the characteristic parameters of the or each hydrological system likely to be traversed by the products.

Certain of these parameters are connected with the pressure of the fluid existing and circulating in the medium studied. The present invention relates to the positioning of an equipment for measuring this pressure and the parameters therefrom according to a technique which is furthermore known. This technique consists in isolating in a borehole a chamber either by cementing or by means of obturators and in measuring the pressure in this chamber, previously filled with a fluid, which results from the direct action of the fluids contained in the medium adjacent the lateral walls of the chamber.

However, this simple technique presents drawbacks, particularly if the analyzed medium is cracked. In fact, it is observed that there is a risk of the fluid of the medium skirting the stoppers or obturators rendering the value of the results obtained at the altitude explored uncertain. In addition, in a slightly permeable medium, the very presence of the borehole disturbs the value of the local pressures.

One of the objects of the present invention is to overcome these drawbacks by proposing a process for preparing the borehole which does not disturb the local pressures to be measured by ensuring a continuity of the medium up to the measuring chamber and which eliminates the errors or variations in measurement due to the phenomena of skirting. The invention also proposes an equipment for carying out this process in order to simplify to a maximum the operations of preparation.

To this end, the invention therefore relates to a process for casing a borehole made in a porous medium for measuring the pressure of the interstitial fluid, whereby there is positioned in the borehole a tube of which at least one section, located at the altitude of the measurement to be effected, possesses radial orifices and a supple inner membrane in the form of a sleeve fitted on the inner face of the tube. According to one of the characteristics of this process, the section possessing its radial orifices along one of its generatrices, a porous band is placed between the borehole wall and the outer surace of the section, at the level of said orifices, the interior of the tube is filled with liquid to apply the membrane against its wall, the space between the tube and the borehole is filled with liquid in order to saturate said porous band and the outer liquid is replaced by a cement grout which bonds the tube to the walls of the borehole in all its zones exempt of porous band.

The invention also relates to a device for carrying out the process mentioned above which comprises a tube formed by the assembly end to end of identical tubular sections, each of them being divided into a plurality of sections which comprise radial orifices along one of their generatrices, the orifices of one section being located on a generatrix different from that of the orifices of the adjacent sections, each section possessing, as cover for said orifices, a porous band coupled to the outer wall of the tube and protecting ribs laterally bordering said porous band.

In one embodiment, each porous band is coupled to the tube by its ends by means of a clamp and the section of tube possesses, between two adjacent clamps, a flange for protecting these clamps.

In another embodiment, the porous band is glued to said tube.

For reasons of simplicity of position, each tubular section is advantageously internally equipped with a supple cylindrical membrane coupled to said section by its ends by means of an assembly flange.

The invention will be more readily understood on reading the description given hereinafter by way of purely indicative and nonlimiting example which will enable the advantages and secondary characteristics thereof to be set forth.

Reference will be made to the accompanying drawings, in which:

FIGS. 1, 2 and 3 illustrate the different phases of the process of casing according to the invention.

FIG. 6 illustrates the positioning of the membrane in the section of FIG. 5.

Figure 4:
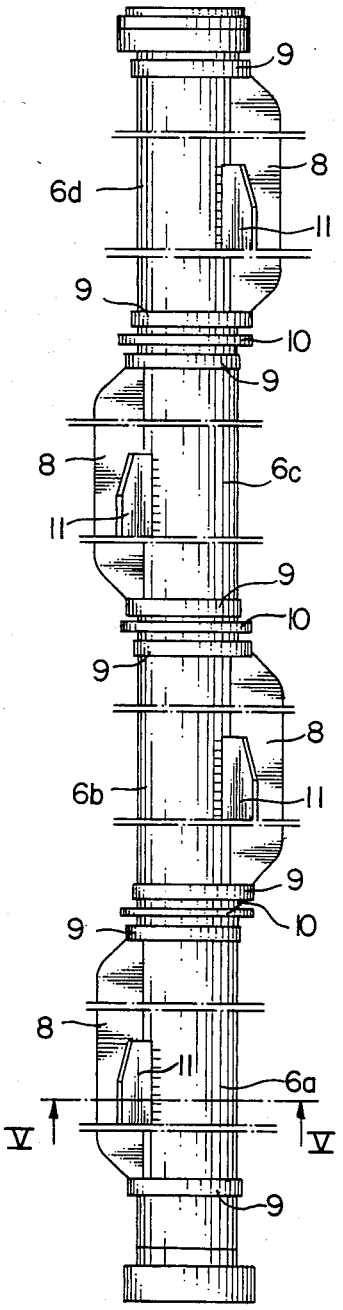
FIG. 4 is an outer view of a section of the device employed.

Referring now to the drawings, and firstly to FIGS. 1 to 3, they show, schematically, a borehole 1 made in a medium 2 which will be constituted by a succession of geological formations of which the number will depened on the depth of the borehole 1. By way of example, this type of borehole may attain a depth of 500 to 1500 meters. In the hole thus made and in accordance with conventional methods, a casing is introduced (cf. FIG. 2) constituted by a plurality of tubular sections 3, 4, . . . n joined end to end by a system of flanges and screws. The inner wall of this casing is coated with a deformable supple membrane 5 of which the maintaining means will be described with reference to FIG. 6. Each section possesses a plurality of sections 6, which will also be described in greater detail with reference to FIGS. 4 and 5, each of these sections being provided with radial orifices 7 disposed along a generatrix. In other words, the radial orifices along one of the generatrice of the tubular sections are the orifices 7. The generatrice is a straight line on each section 6*a* and 6*b* of the tube.

In accordance with the characteristic arrangements of the invention, there is placed between the outer wall of each section 6 of tube and the wall of the bore hole 1, a porous band 8 of the latex foam type or other natural or synthetic material, which re-establishes a continuity of solid and porous medium between the medium and said orifices. To facilitate positioning, these porous bands are previously coupled to the tube.

The casing process then consists in filling the interior of the membrane 5 with a liquid (water for example) and the space located between the tube and the walls of the borehole in order that each of the porous bands 8 be saturated. FIG. 2 illustrates this stage of positioning.

FIG. 3 illustrates the last phase of the process according to the invention whereby the water located between the wall of the borehole 1 and the tube is replaced by a cement 9 intended on the one hand to bond all the parts of the tube exempt of bands to the geological formations and on the other hand to avoid skirting flows. Cementing is effected in known manner by means of an injection rod let down inside the measuring casing. From time to time, at determined levels, distance for example by 50 or 100 meters, a section of casing is replaced by an injection tube equipped with an outer elastic sleeve forming valve for retaining the cement. Monitoring of the level of grout in the annular space is effected in likewise known manner, in particular taking into account the variation in pressure due to the difference in density between the water and the grout at a considered point (for example the point of injection). The pressure is measured by gauges disposed in the tube at the level of the orifices 7.

The porous band will have been chosen in a material (foam) which is sufficiently permeable in order not to introduce a reduction in flow between the massif to be studied and the radial orifices of the tube. Furthermore, it will be suitable to employ a foam sufficiently dense for the differential pressure existing on one band, when the water-grout interface passes therethrough, not to provide an expulsion of the water impregnating the foam upwardly. In fact, such a wringing out could lead to a deformation of the geometry of the band and consequently a risk of loss of contact of the latter with the wall of the borehole. Satisfaction of these two contradictory requirements is obtained by the use of a dense latex foam which further presents a good resistance to abrasion. The nature of the cement grout will furthermore be determined to effect a good tightness in the bond and perfectly to insulate the different porous bands from one another. To this end, chemical additives will have been employed or elements known for their impermeability will have been added.

FIG. 4 shows in an outside view a section such as 3, 4 or n of FIGS. 2 and 3. This tubular section possesses four sections 6*a* to 6*d*, each of them being provided with a series of radial orifices (not shown) along a generatrix. In this case of Figure, the radial orifices of one section are located on the generatrix diametrically opposite the generatrix bearing the orifices of the adjacent sections. As a cover of these orifices, a porous band 8 has been placed, coupled to the tube by its ends by means of clamps 9. Protection of the clamps 9 is ensured by a flange 10 welded to the tube of larger diameter in order to preserve the clamps from contact with the walls of the borehole during descent of the casing. Furthermore, protection of the porous bands 8 is ensured by ribs 11 which border them laterally. By way of example, it will be indicated that the section shown is about 5 meters long for an inner diameter of about 80 millimeters. Each series of orifices and corresponding band has a length of about 1.20 meter.

Figure 5:
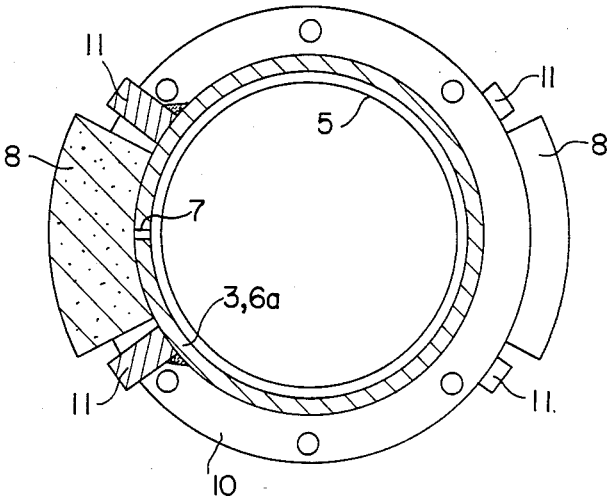
FIG. 5 is a section along line 5—5 of FIG. 4.

FIG. 5 shows certain of the elements described with reference to the preceding Figures with the same references. It will be noted that the bands 8 may be fixed by gluing to the tube. In this case, care will be taken not to clog the orifices 7 and the pores of the band 8 at this level with the bonding agent.

Finally, in FIG. 6, it will be noted that the tubular section 4 is equipped with an inner cylindrical membrane 5 made of supple, even elastic material, maintained in place inside the section by pinching at each of its ends between the conical surfaces 12*a* 12*b* borne by the tube and conical surfaces 13*a* 13*b* respectively borne by flanges 14, 15 maintained by screwing to the ends of the section 4. These flanges cooperate with collars 16, 17 of the section provided with the smooth orifices or taps for fixing the adjacent section by means of screws passing through the flanges. Also to be noted is the presence of a centering stud 18 allowing angular indexation of one section with respect to the other, in order to respect the alternate distribution of the porous bands along the casing. This distribution is effectively to be respected for there to be a good distribution of the grout during cementing.

A diametrically opposite arrangement of the different porous bands along the casing has been described hereinabove. To envisage a different angular shift would not depart from the scope of the invention.

The invention finds interesting application in the domain of hydro-geological studies.

I claim:

1. Process for casing a borehole made in a porous medium for measuring the pressure of interstitial fluid which soaks said porous medium, whereby there is positioned in the borehole a tube of which at least one section, located at the depth of the measurement to be effected, possesses radial orifices and a supple inner membrane in the form of a sleeve fitted on an inner face of the tube, characterized in that, the section possessing its radial orifices along one of its generatrices, each generatrice being a straight line on each section of the tube, a porous band is placed between the borehole wall and an outer surface of the section, at the level of said orifices, the interior of the tube is filled with an inner liquid to apply the membrane against its wall, a space between the tube and the borehole is filled with an outer liquid in order to saturate said porous band and the outer liquid is replaced by a cement grout which bonds the tube to the walls of the borehole in all its zones exempt of porous band.

2. A device for carrying out a process for casing a borehole made in a porous medium for measuring the pressure of interstitial fluid which soaks said medium, characterized in that said device comprises a tube formed by the assembly end to end of identical tubular sections, each of them being divided into a plurality of sections which comprise radial orifices along one of their generatrices, each generatrice being a straight line on each section of the tube, the orifices of one section being located on a generatrix different from that of the orifices of the adjacent sections, each section possessing, as cover for said orifices, a porous band coupled to an outer wall of the tube and protecting ribs laterally bordering said porous band.

3. Device according to claim 2, characterized in that each porous band is coupled to the tube by its ends by means of a clamp.

4. Device according to claim 3, characterized in that the section of tube possesses, between two adjacent clamps, a flange for protecting these clamps.

5. Device according to claim 2, characterized in that the porous band is glued to said tube.

6. Device according to claim 2, characterized in that each tubular section is internally equipped with a supple cylindrical membrane coupled to said section by its ends by means of an assembly flange.

7. Apparatus for casing a borehole made in a porous medium for measuring the pressure of interstitial fluid which soaks said porous medium comprising a tube of at least one section positioned in the borehole so as to be located at the depth of the measurement to be effected and possessing radial orifices, a supple inner membrane in the form of a sleeve fitted on an inner face of the tube, the section possessing its radial orifices along one of its generatrices, each generatrice being a straight line on each section of the tube, a porous band placed between the borehole wall and an outer surface of the section, at the level of said orifices, the interior of the tube being filled with an inner liquid to apply the membrane against its wall, a space between the tube and the borehole being filled with an outer liquid in order to saturate said porous band, and the outer liquid being replaced by a cement grout which bonds the tube to the walls of the borehole in all its zones exempt of porous band.

* * * * *